US005410461A

United States Patent [19]

Petzl

[11] Patent Number: 5,410,461

[45] Date of Patent: Apr. 25, 1995

[54] ELECTRIC LIGHTING LAMP WITH DOUBLE LIGHT SOURCE

[75] Inventor: Paul Petzl, Barraux, France

[73] Assignee: Zedel, Crolles, France

[21] Appl. No.: 276,656

[22] Filed: Jul. 19, 1994

[30] Foreign Application Priority Data

Aug. 3, 1993 [FR] France ..... 93 09651

[51] Int. Cl.[6] ..... F21V 23/04

[52] U.S. Cl. ..... 362/251; 362/232; 362/285

[58] Field of Search ..... 362/227, 250, 251, 285, 362/289, 295, 372, 232

[56] References Cited

U.S. PATENT DOCUMENTS 4,336,579 6/1982 Lord ..... 362/272

4,533,984 8/1985 Gatton ..... 362/250 X

FOREIGN PATENT DOCUMENTS 2336629 7/1977 France .

146987 8/1931 Switzerland .

*Primary Examiner*—Stephen F. Husar

*Attorney, Agent, or Firm*—Stevens, Davis, Miller & Mosher

[57] ABSTRACT

A lighting lamp comprises two bulbs connected in an electrical circuit with a common control device, the assembly being supported by a support plate made of insulating material. The control device is equipped with a switching bar having two actuating cams cooperating alternatively with two contact strips constituting the first and second switches. A mechanical latch enables the control device to be locked in the break position. An adjustment knob is designed to focus the light beam emitted by the first bulb.

10 Claims, 11 Drawing Sheets

ELECTRIC LIGHTING LAMP WITH DOUBLE LIGHT SOURCE

BACKGROUND OF THE INVENTION

The invention relates to an electric lighting lamp with double light source housed in a case, and containing:

a first bulb fitted in a first connecting base, a second bulb fitted in a second connecting base, and extending parallel to the first bulb, an electrical circuit equipped with a control device of two switches, which are connected respectively in series with said first and second bulbs, and a reflector and transparent screen element for transmission of the light beam emitted by each of said bulbs.

In a known lamp of the kind referred to, the device controlling the two switches is formed by a common selector switch having several successive selection positions, i.e. two Off positions, and two other On positions of the lighting. Moving from a break position to a make position to supply a bulb is achieved by a one-step rotation action of the selector switch, which is formed by a component having output studs electrically connected in the electrical supply circuit of the bulbs. Using a rotary selector switch of this kind implies multiple welds in the electrical circuit, which increases the assembly and manufacturing time of the lamp. In the case where the lamp is used as a head-mounted lamp, it is moreover particularly uneasy to identify with accuracy which of the two light bulbs is lit or extinguished when the lamp is fixed on the user's head.

In a mechanism described in the document U.S. Pat. No. 4,336,579, the same actuating device controls the two switches of the bulbs and the translation movement of the bulb with adjustable focus. A control of this kind requires a large angular movement.

SUMMARY OF THE INVENTION

The object of the invention consists in achieving a lighting lamp with double light source having a simple control for ease of assembly and connection of the electrical circuit.

Another object of the invention consists in enabling adjustment of the light beam of one of the bulbs independently from control of the electrical circuit.

The lamp according to the invention is characterized in that it comprises in addition:

a plate supporting the two connecting bases and the electrical circuit, said plate being made of insulating material and subdividing the inside of the case into a first front compartment receiving the bulbs, and a second rear compartment housing the electrical circuit, a switching bar of said control device having two actuating means staggered along a transverse axis in the second compartment, and cooperating alternatively with contact strips constituting the first and second switches to control total extinction or lighting of one of the light bulbs depending on whether the control device is in a break position or an active position, said switching bar being mounted with rotation in a bearing on one of the side faces of the case on the same side as the second fixed-focus bulb, and an adjustment knob separated from the control device and designed to move the first connecting base to focus the light beam emitted by the first bulb.

The control device comprises a lever or handle coupled to the switching bar and capable of occupying selectively three distinct angular positions, said break position being situated half-way between the two active end-of-travel positions.

Manual action with one hand performs control of the accurate lighting of one of the bulbs, whereas the other hand enables the light beam of the first bulb to be adjusted. In case of use of a head-mounted lamp, these two distinct control and adjustment actions are performed easily with the lamp fitted on the user's head.

For transporting the lamp in a bag or pocket, the control device simply has to be locked in rotation by depressing a latch to a locked position.

The electrical circuit comprises a plurality of contact elements in the form of interconnected blades, having at least one deformable connection zone arranged between the first movable connecting base and the two movable contact strips of the switches to ensure electrical continuity when the adjustment knob is rotated.

BRIEF DESCRIPTION OF THE DRAWINGS

Other advantages and features will become more clearly apparent from the following description of an illustrative embodiment of the invention, given as a non-restrictive example only and represented in the accompanying drawings in which.

DESCRIPTION OF THE PREFERRED EMBODIMENT

Figure 1:
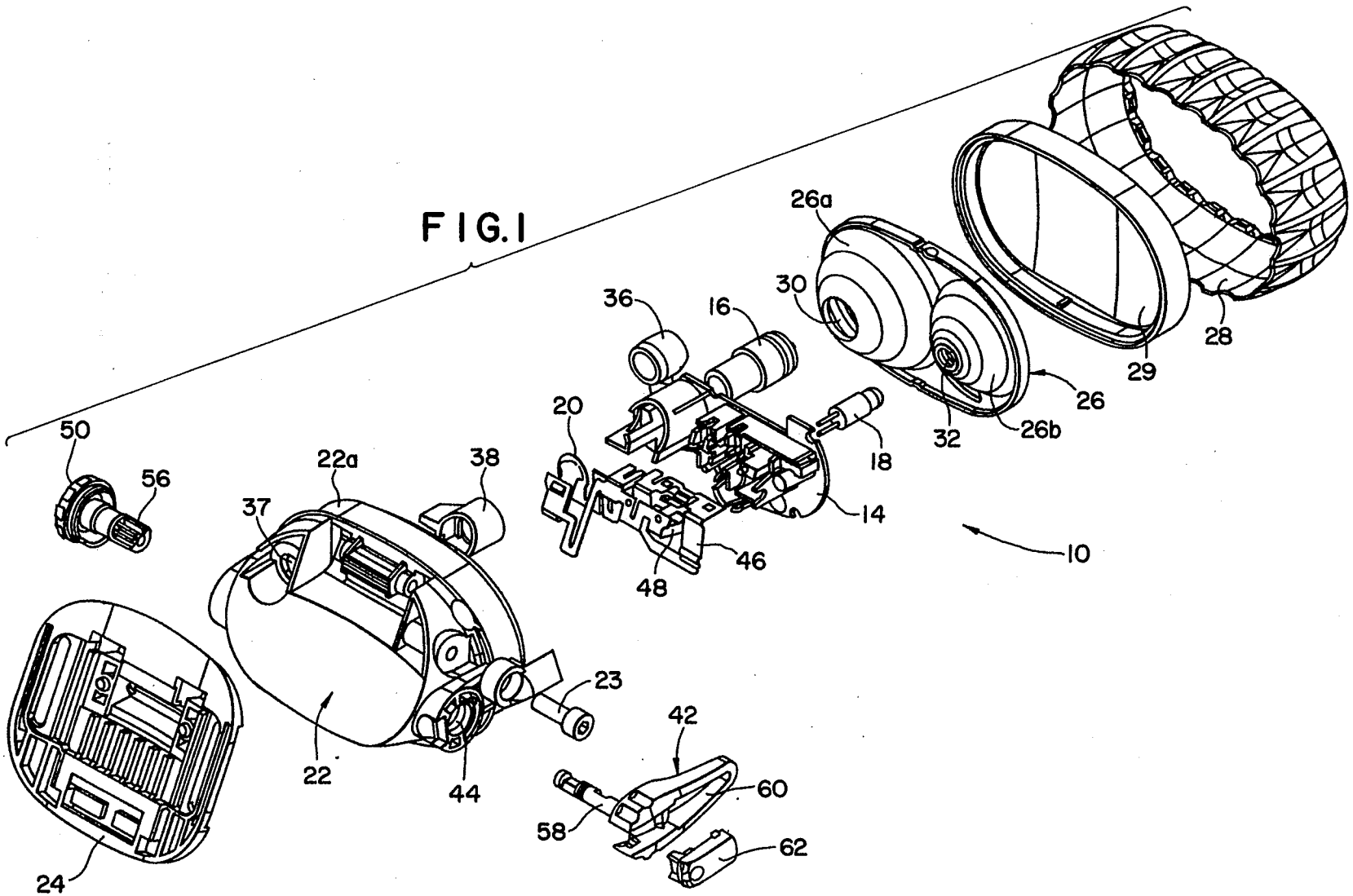
FIG. 1 is an exploded perspective view of the lamp according to the invention.
Figure 2:
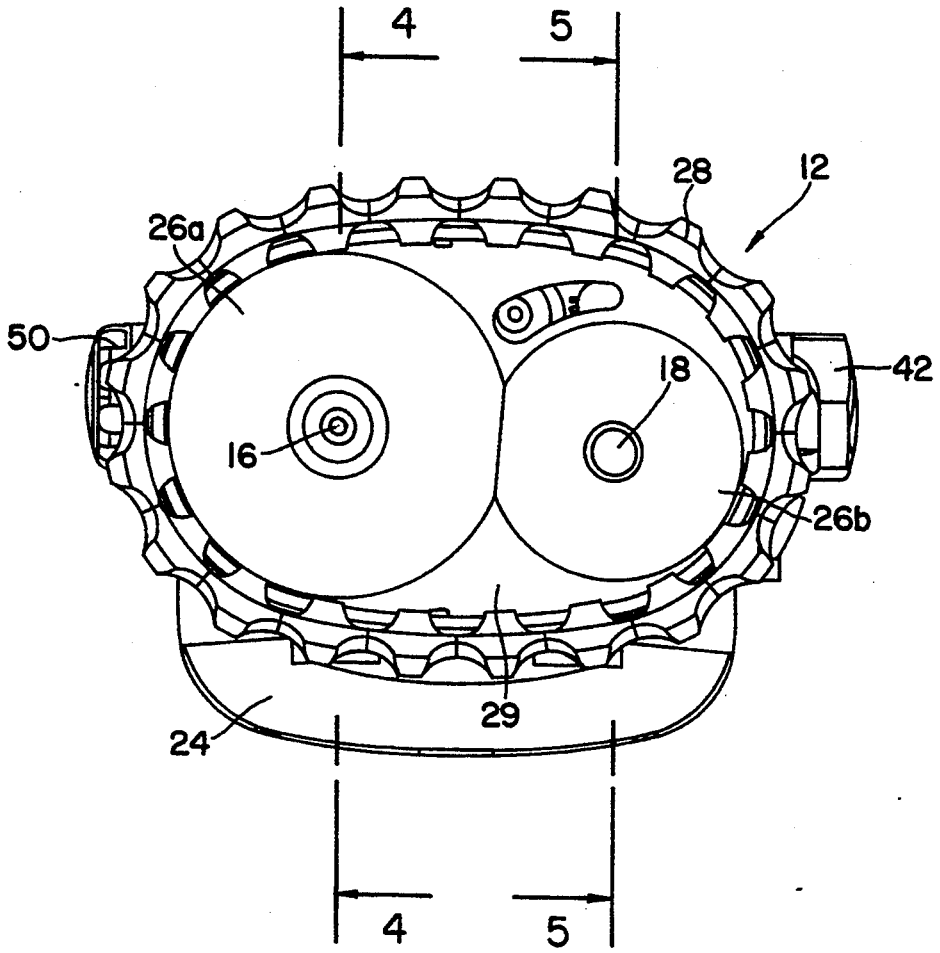
FIG. 2 represents a front view of the lamp.
Figure 3:
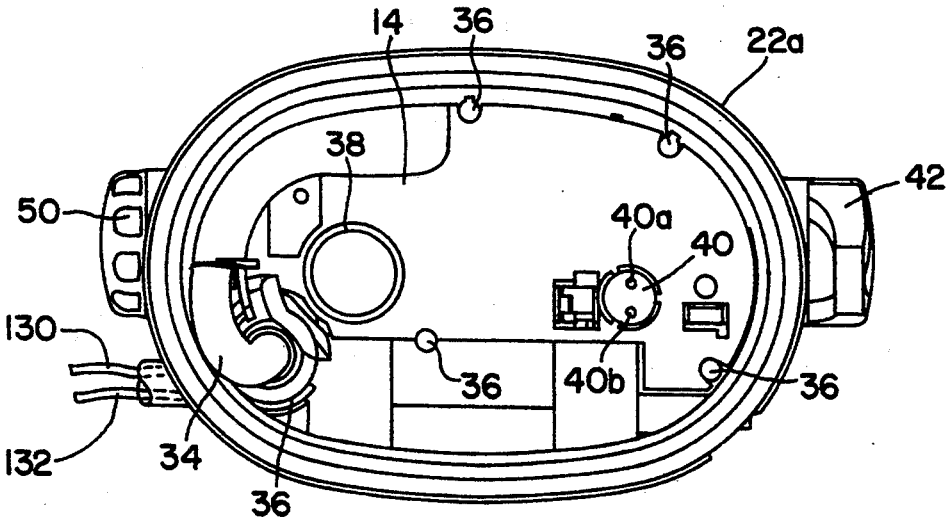
FIG. 3 represents a front view of the lamp after the bulbs and reflector assembly have been removed.

Referring to FIGS. 1 to 3, an electric lighting lamp 10 with double light source is equipped with a case 12 made of insulating material containing an intercalated plate 14 acting as connecting support for a pair of electric light bulbs 16, 18 connected to an electrical circuit 20. The case 12 is composed of a housing 22 pivotally mounted on the spindle 23 of a flange 24, and a double reflector element 26 securedly united to the plate 14 by means of a fixing ring 28 screwed onto the ellipsoid-shaped front part 22*a* of the housing 22 with a transparent screen 29 interposed.

The double reflector element 26 comprises a first reflector 26*a* having a first central orifice 30 through which the first bulb 16 passes, and an adjacent second reflector 26*b* provided with a second central orifice 32 through which the second bulb 18 passes.

The electrical circuit 20 is electrically connected to an external power source (not represented) by a supply cable 34 passing through a socket 36 of the plate 14, in alignment with a hole 37 arranged in the bottom of the housing 22. The plate 14 is threaded from the front part 22*a* onto guiding and positioning studs 36 cast with the housing 22. Each stud 36 comprises a branch fixed to the bottom of the housing 22 and extending appreciably in a direction perpendicular to the screen 29. The plate 14 bears a first connecting base 38 for receiving the bottom of the first bulb 16, and a second connecting base 40 having two orifices 40*a*, 40*b* for receiving a pair of connecting pins 39, 41 of the second bulb 18.

A rotary operating part or lever 42 with three positions is pivotally mounted in a bearing 44 of the housing 22 to alternately actuate two switches 46, 48 of the electrical circuit 20, controlling lighting or switching off respectively of the bulbs 16, 18. Opposite the operating lever 42 there is located an adjustment knob 50 designed to position the first base 38 with respect to the first fixed reflector 26*a* to focus the light beam emitted by the first bulb 16.

The supply cable 34 of the electrical circuit 20 contains two conductors 130, 132 connected to the terminals of opposite polarities of the DC power source. Connection of the electrical circuit 20 is achieved by inserting the two ends 130*a*, 132*a* of the two conductors 130, 132 in the self-baring contacts 84, 106 of the first and third contact strips 76, 80 (see FIG. 7).

Figure 4:
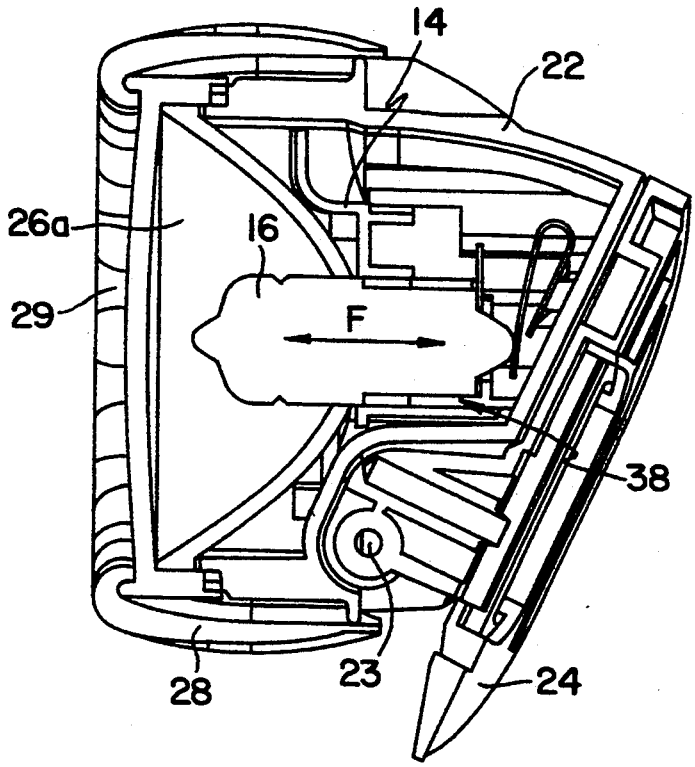
FIGS. 4 and 5 are cross-sectional views along the respective lines 4—4 and 5—5 of FIG. 2.

In FIG. 4, the first bulb 16 is surrounded by the first parabolic-shaped fixed reflector 26*a*, and the bottom of the bulb 16 is screwed into the first connecting base 38, which is movable in translation in the direction of the arrow F when the adjustment knob 50 is actuated in rotation.

Figure 5:
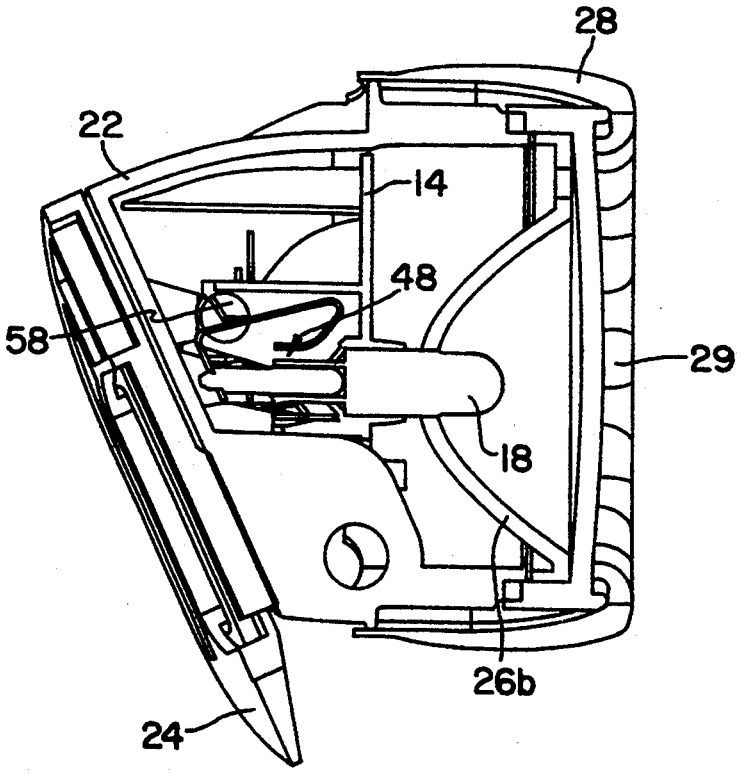

With reference to FIG. 5, the surface of revolution of the second reflector 26*b* is smaller than that of the first reflector 26*a* of FIG. 4. The second bulb 18 extends parallel to the first bulb 16 according to a direction appreciably perpendicular to the common transparent screen 29. The connecting pins 39, 41 of the second bulb 18 are inserted in the orifices 40*a*, 40*b* of the second connecting base 40, which is securedly affixed to the plate 14. The switch 48 is formed by a flexible contact blade cooperating with one of the pins 39 of the bulb 18 due to the action of the operating lever 42.

Figure 6:
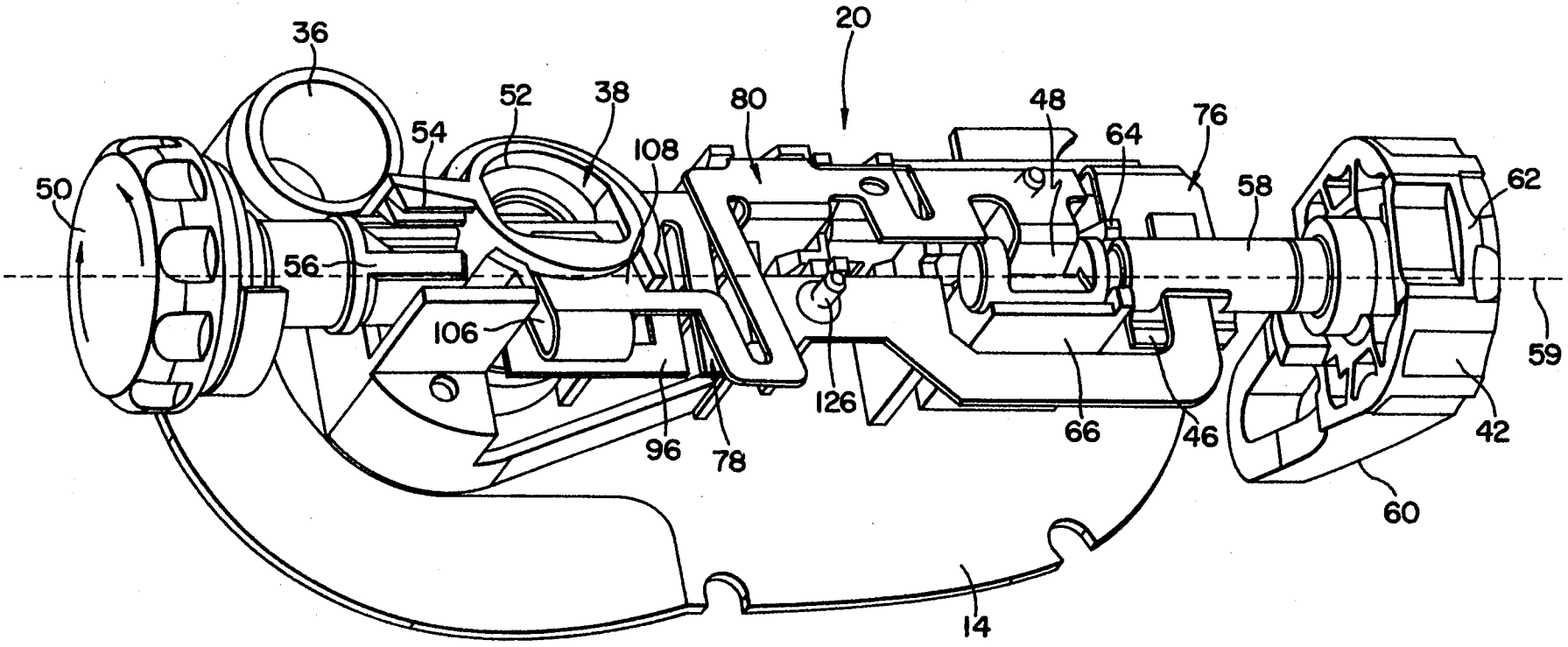
FIGS. 6 and 7 represent perspective views at two different angles of the rear part of the plate equipped with an electrical circuit.
Figure 7:
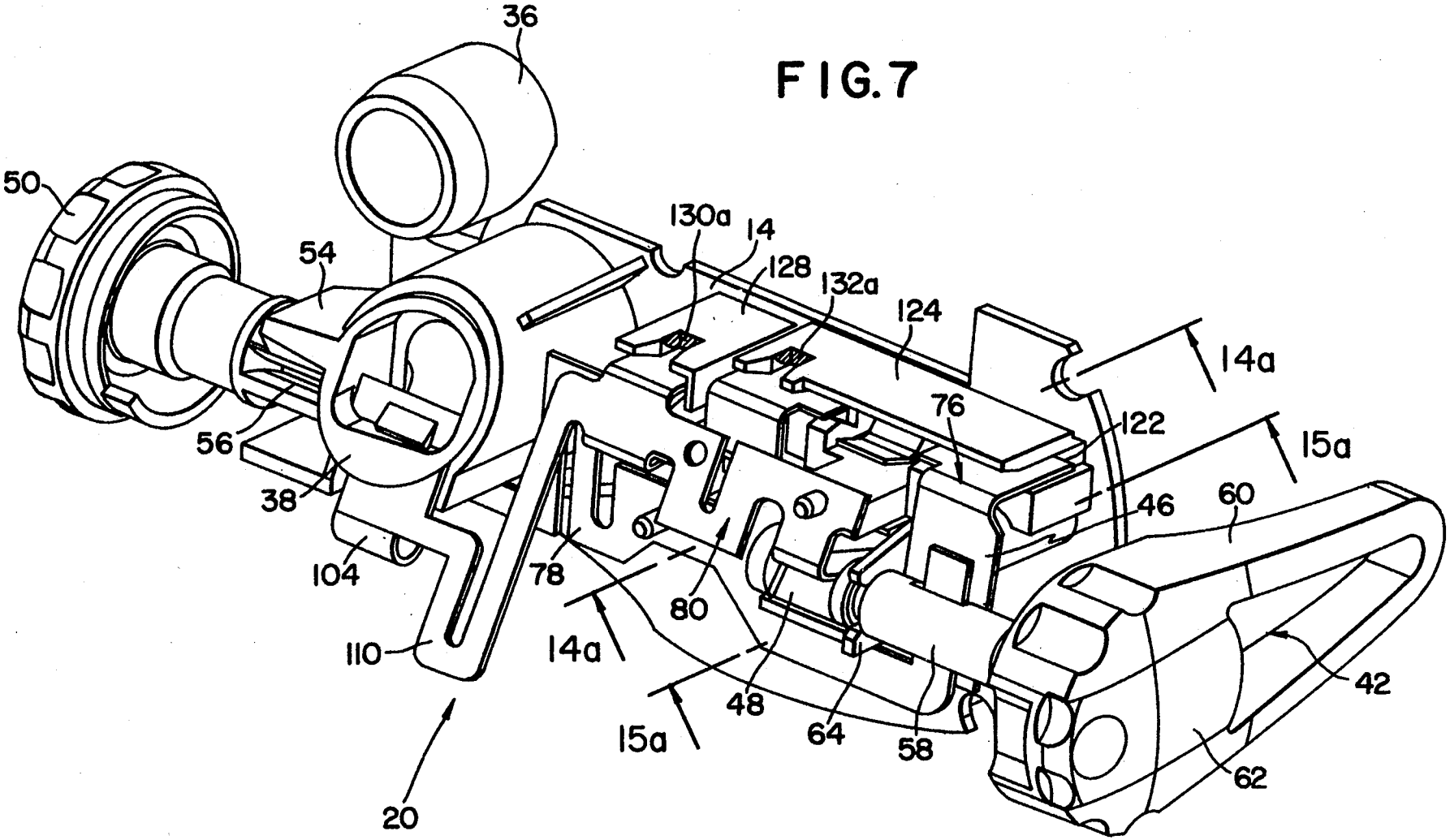

FIGS. 6 and 7 represent the rear part of the plate 14, equipped with the electrical circuit 20, the operating lever 42 of the switches 46, 48, and the adjustment knob 50.

The first connecting base 38 comprises a cylindrical socket 52 supporting the first bulb 16, and a drive device with crown-wheel 54 cooperating with a pinion 56 of the adjustment knob 50. The teeth of the pinion 56 extend along a sector representing a fraction of the circumference of the spindle, so as to define with precision the length of the translation travel of the first base 38 when the knob 50 is actuated in rotation between the two extreme adjustment positions.

The operating lever 42 is equipped with a switching bar 58 aligned with the pinion 56 of the knob 50 along a transverse axis 59 parallel to the plane of the screen 29. The two ends of the pinion 56 and switching bar 58 are separated from one another by a central space housing the electrical circuit 20.

Figure 11:
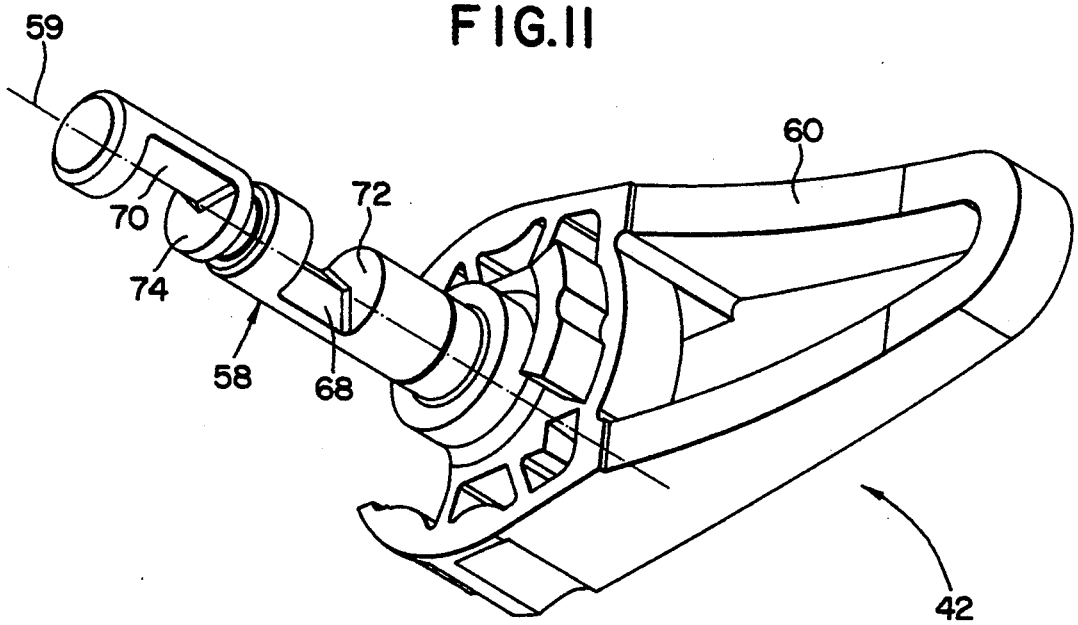
FIG. 11 represents an enlarged scale perspective view of the control device of the two switches.

The structure of the operating lever 42 is illustrated in detail in FIGS. 6, 7 and 11.

The lever 42 comprises a gripping handle 60 perpendicular to the switching bar 58, and a latch 62 locking the handle 60 in the central position, corresponding to disconnection of the two switches 46, 48. Guiding of the cylindrical bar 58 of the operating lever 42 in rotation is performed by means of the bearing 44 of the housing 22, and an intermediate U-shaped bearing 64 supported by a protuberance 66 of the plate 14. The bar 58 comprises a first actuating means 68 and a second actuating means 70 cooperating respectively with flexible contact blades of the electrical circuit 20 to constitute the two switches 46, 48. Each actuating means 68, 70 is formed by a cam arranged inside a cavity 72, 74 of the bar 58. The two cavities 72, 74 are staggered along the transverse axis 59 with a preset angular offset, enabling one switch 46, 48 only to be operated at the same time, depending on whether the lever 42 is in one of the two make positions, situated on each side of the central break position.

Figure 8:
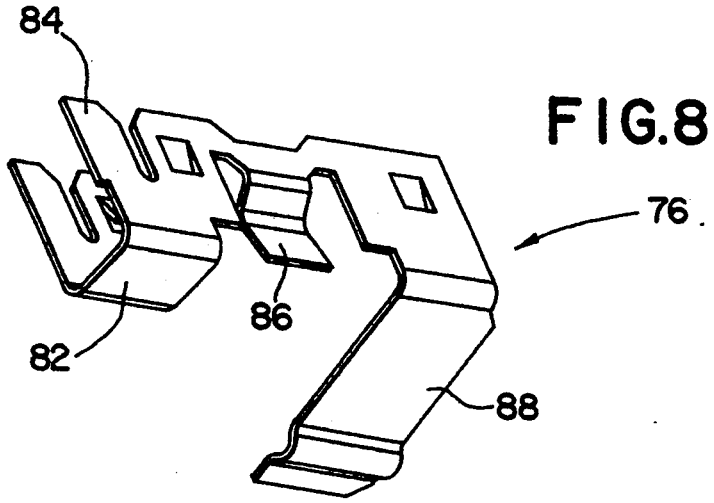
FIG. 8 is a perspective view of the first contact element of the electrical circuit.
Figure 9:
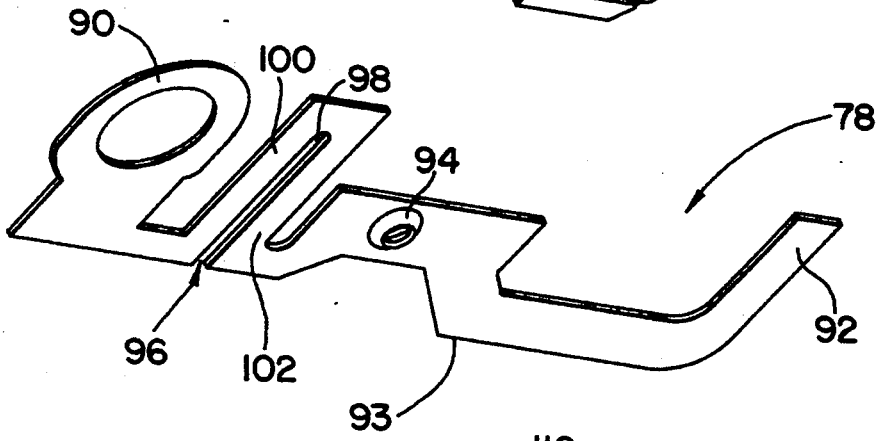
FIG. 9 is a perspective view of the second contact element of the electrical circuit.
Figure 10:
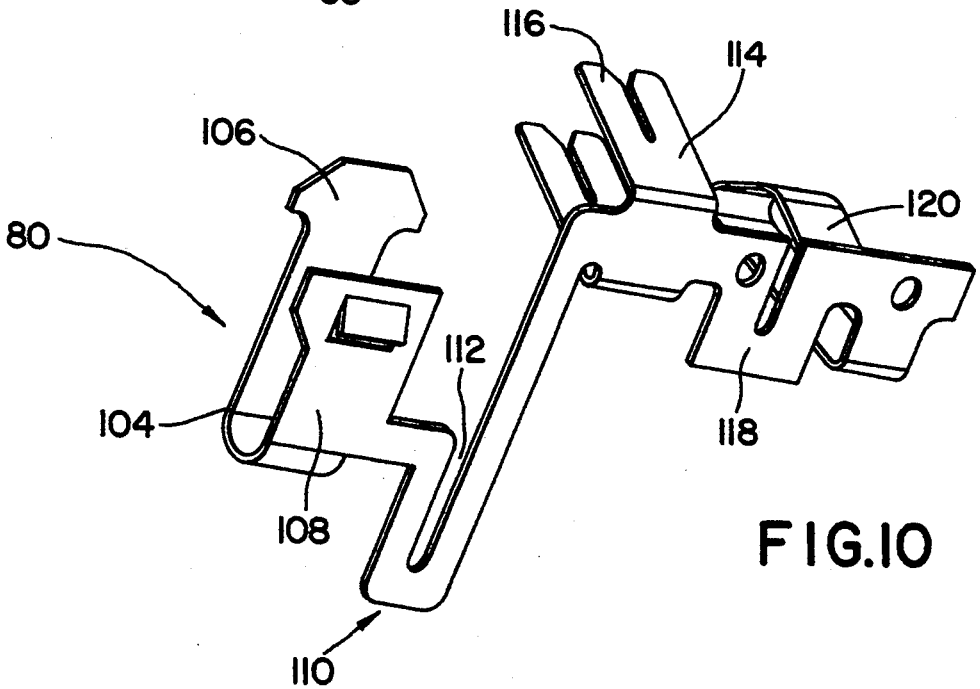
FIG. 10 is a perspective view of the third contact element of the electrical circuit.

The electrical circuit 20 illustrated in FIGS. 6 and 7 is composed of three distinct contact elements 76, 78, 80 individually represented in FIGS. 8 to 10. Each contact element 76, 78, 80 is formed by a flexible conducting blade of specific structure, obtained by cutting and folding operations.

The first contact element 76 (FIG. 8) comprises an end 82 with self-baring contact 84, a first intermediate contact strip 86 designed to come into permanent engagement with the pin 41 of the second bulb 18, and a second contact strip 88 forming part of the first switch 46.

The second contact element 78 (FIG. 9) is equipped with an earth ring 90 designed to be in permanent contact with the bottom of the first bulb 16 when inserted in the base 38, and a third contact strip 92 cooperating with the second contact strip 88 to form the first switch 46. The central part 93 is provided with a fixing hole 94, and with a first deformation zone 96 with slot 98 arranged between the ring 90 and hole 94. The slot 98 is bounded by two adjacent parallel branches 100, 102 extending perpendicularly to the central part 93.

The third contact element 80 (FIG. 10) comprises a curved U-shaped end 104 having a fourth contact strip 106 designed to come into permanent contact with the isolated terminal of the first bulb 16, and a wing 108 holding the end 104 in the socket 52 of the first base 38. A second deformation zone 110 with slot 112 joins the end 104 to a connecting bracket 114 with self-baring contact 116. A third deformation zone 118 is intercalated between the bracket 114 and a fifth contact strip 120 forming part of the second switch 48.

The arrangement of the three contact elements 76, 78, 80 on the plate 14 is as follows:

The first contact element 76 is first inserted in a housing groove 122 (FIG. 7) provided in an extension 124 of the plate 14. The second contact element 78 is then secured to the plate 14 after positioning of the central hole 94 on a fixed pin 126. The earth ring 90 is housed in an aperture of the first movable connecting base 38, whereas the third contact strip 92 is arranged facing the second contact strip 88.

The third contact element 80 is finally disposed above the other two contact elements 76, 78, being fixed by its bracket 114 onto a hollow boss 128 securedly united to the plate 14. The end 104 is engaged in the aperture of the first base 38 so as to position the fourth contact strip 106 facing the earth ring 90. The fifth contact strip 120 penetrates into a cavity inside the protuberance 66, being arranged facing the pin 39 of the second bulb 18 when this bulb is inserted in the second connecting base 40.

The supply cable 34 of the electrical circuit 20 contains two conductors 130, 132 connected to the terminals of opposite polarities of the DC power source. Connection of the electrical circuit 20 is achieved by inserting the ends 130*a*, 132*a* of the two conductors 130, 132 into the self-baring contacts 84, 106 of the first and third contact strips 76, 80 (see FIG. 7).

Figure 12:
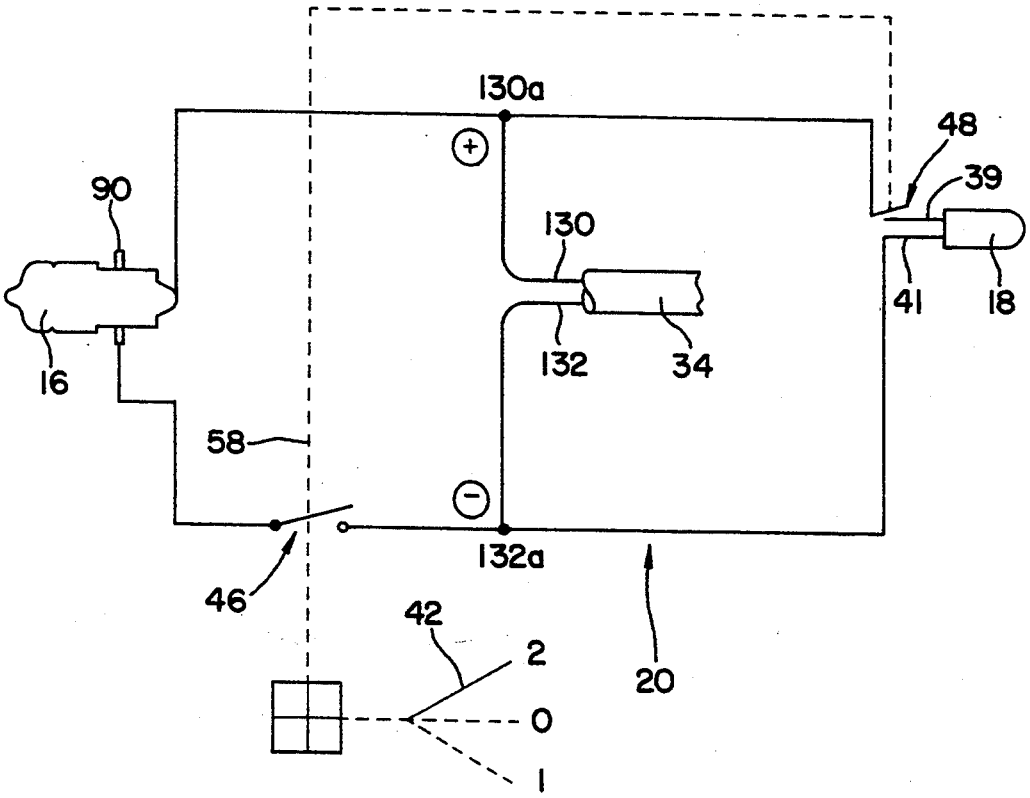
FIG. 12 shows the electrical diagram of the lamp.
Figure 13A:
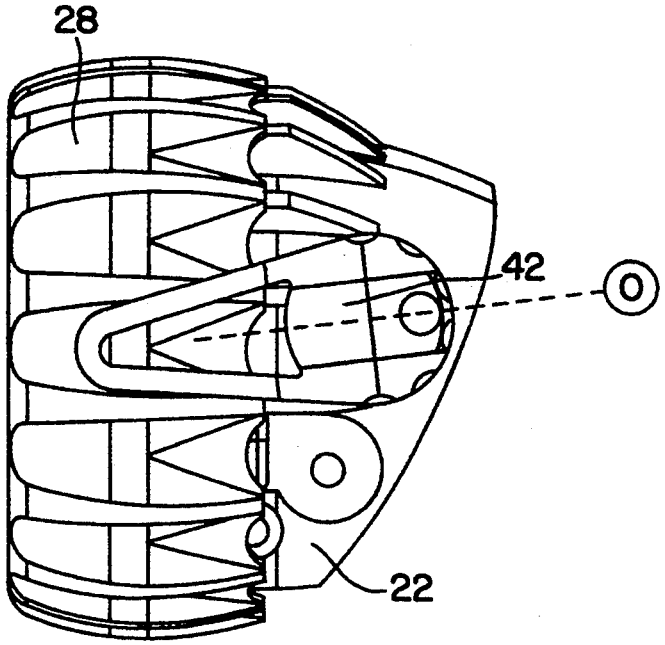
FIGS. 13A, 13B, 13C each show a side view of FIG. 2 when the control device of the switches is respectively in the break position 0, in the active position 2, and in the active position 1.
Figure 14A:
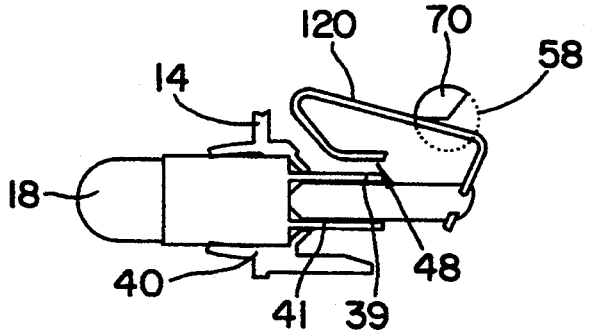
FIGS. 14A, 14B, 14C are cross-sectional views along the line **14*a*—14*a* of FIG. 7** respectively in the above-mentioned positions of the control device.

The diagram (FIG. 12) of the electrical circuit 20 shows the connection of the first switch 46 in the earth ring circuit 90 of the first bulb 16. The connection point 132*a* is connected to the negative polarity of the power source. The second switch 48 controlling the second bulb 18 is electrically connected to the connection point 130*a* which is at the opposite potential, corresponding to the positive polarity of the power source.

Figure 15A:
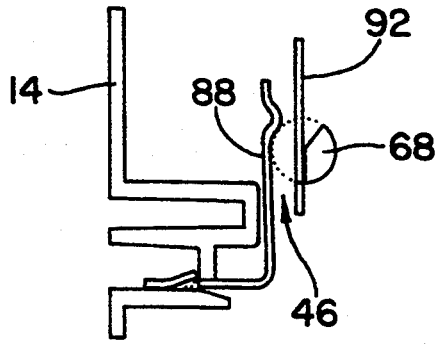
FIGS. 15A, 15B, 15C are cross-sectional views along the line **15*a*—15*a* of FIG. 7** respectively in the above-mentioned positions of the control device.
Figure 14B:
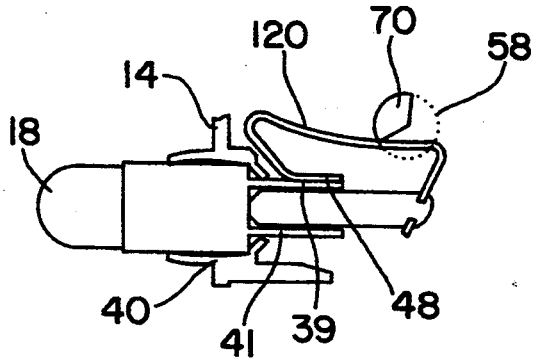
Figure 15B:
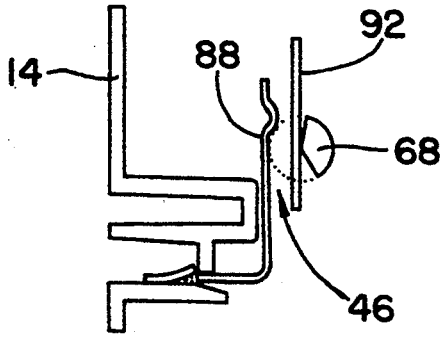

Operation of the double lighting system of the lamp 10 is illustrated in FIGS. 13A to 15C:

In the intermediate position O of the operating lever (FIG. 13A) corresponding to the break position of the lamp 10, the two switches 46, 48 are open, resulting in the two light bulbs 16, 18 being switched off. The second actuating means 70 of the switching bar 58 does not press the fifth contact strip against the pin 39 (FIG. 14A), and the second switch 48 is kept in the open state by the elasticity effect of the strip 120. In FIG. 15A, it can be seen that the first actuating means 68 of the bar 58 is inactive, causing separation of the second and third contact strips 88, 92 corresponding to the open state of the first switch 46.

It is possible to lock the operating lever 42 in the break state by lowering the latch 62 of the handle 60 to a depressed position (not represented), preventing any rotation of the lever 42 to the other two positions 1 and 2. Any untimely lighting of the bulbs 16 and 18 is rendered impossible by this locking effect of the handle 60, which is particularly useful when transporting the lamp 10, notably in a bag or a pocket.

To put the lamp 10 into operation, the latch 62 has to be reset to the unlocked position (FIG. 7), which enables alternate pivoting of the operating lever 42 to one of the active positions 1 or 2 depending on whether the user wants to use the lighting by the first bulb 16 or by the second bulb 18.

In the lowered position 2 of the operating lever 42 (see FIG. 13B), the second switch 48 is closed following the action of the second actuating means 70 of the bar 58 on the fifth contact strip 120. The first switch 46 remains continuously open in this position of the handle 60. The second bulb 18 is lit, whereas the first bulb 16 is extinguished.

Figure 13B:
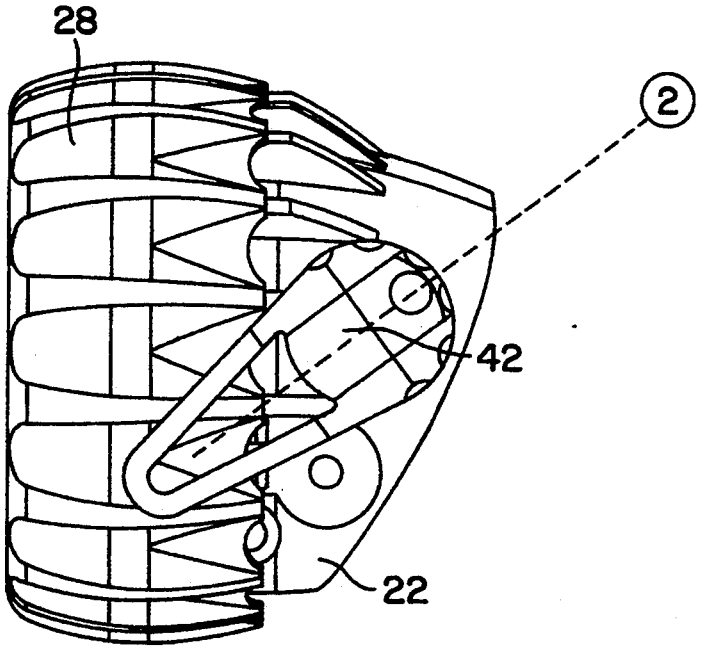
Figure 13C:
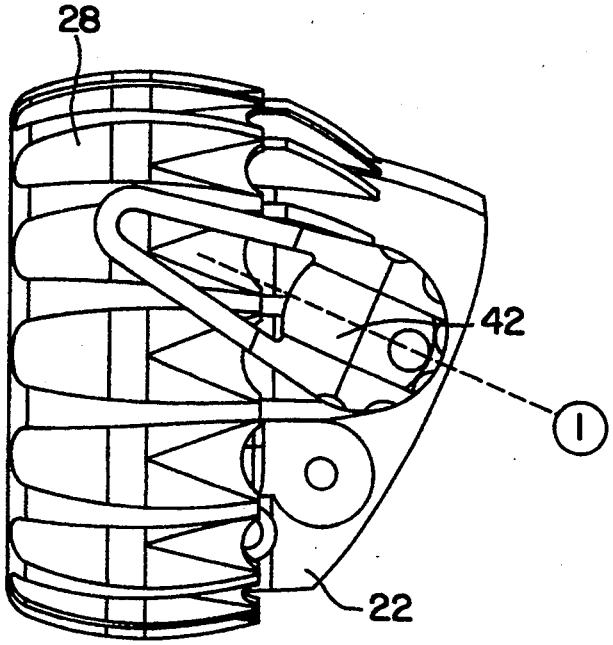
Figure 14C:
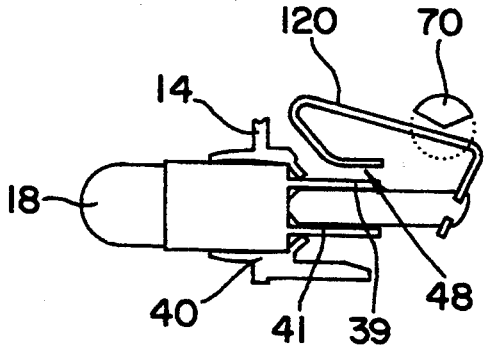
Figure 15C:
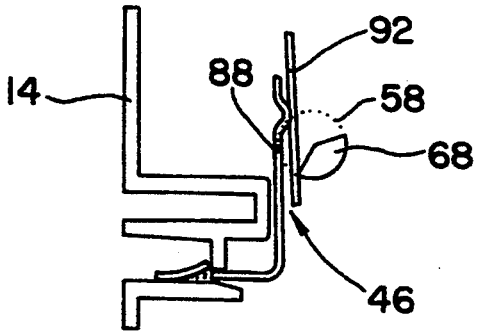

To light the first bulb 16, the operating lever 42 simply has to be moved clockwise to the raised position 1 after passing through the break position 0 (FIG. 13C). Rotation of the switching bar 58 causes over-riding of the second actuating means 70, and opening of the second switch 48 (FIG. 14C), whereas the first actuating means 68 presses the third contact strip 92 against the second contact strip 88 to close the first switch 46.

Figure 16:
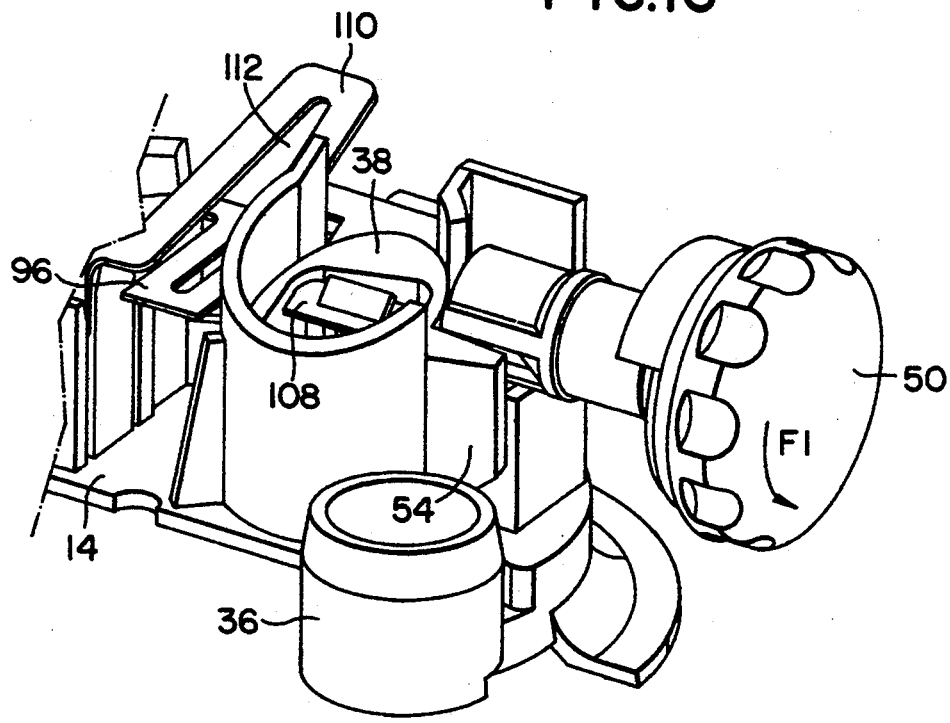
FIGS. 16 and 17 show views of perspective details of the adjustment device of the light beam of the first bulb, the device being represented in two different positions.

Focusing of the light beam emitted by the first bulb 16 is performed by means of the rotary adjustment knob 50, after closing of the first switch 46 in position 1 of the lever 42. In the adjustment position of FIG. 16, the knob 50 is turned in the direction of the arrow F1 to move the first base 38 in the direction towards the first reflector 26*a*.

Figure 17:
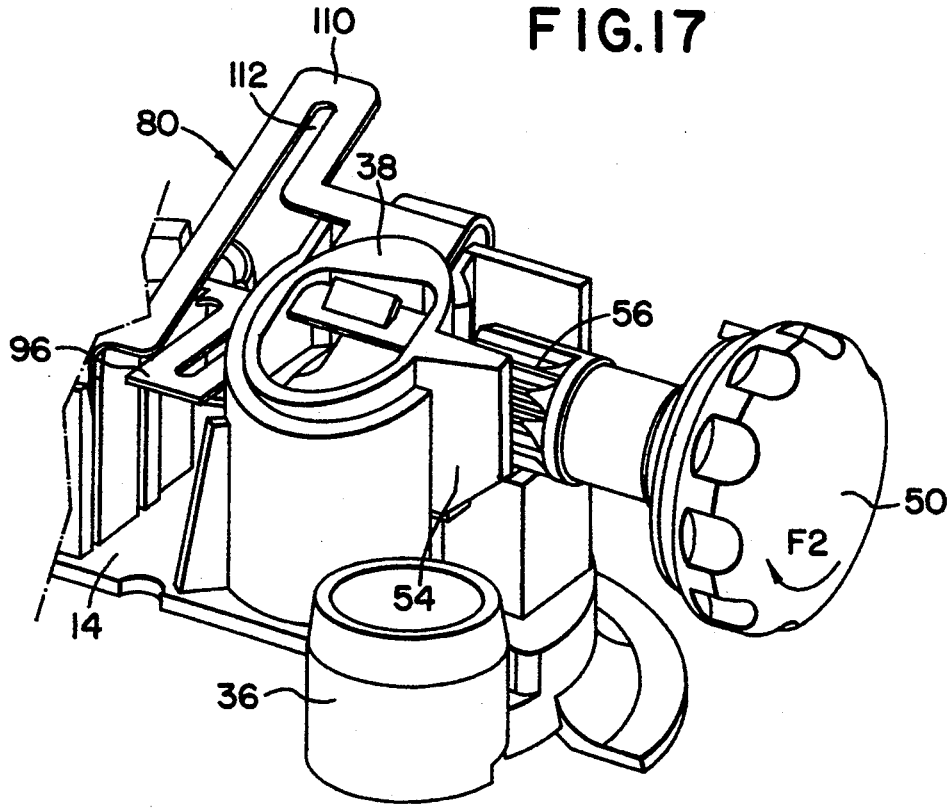

The opposite adjustment is performed in FIG. 17 by turning the knob 50 in the opposite direction (arrow F2), while keeping the lever 42 in the same position 1. The rotation movement of the knob 50 progressively moves the first base 38 away from the first reflector 26*a* and modifies the width of the light beam with respect to the previous adjustment of FIG. 16.

Electrical continuity is ensured during the translation movement of the first connecting base 38 of the first bulb 16 due to the elastic flection of the second deformation zone 110 which follows the movement of the first base 38, while keeping the first switch 46 closed.

The choice of lighting the lamps 16, 18 depends on the use and autonomy required by the user. The first lamp 16 generally has a greater power than that of the second lamp 18. The lighting of the first lamp is therefore better, but to the detriment of the electrical consumption, and of the autonomy time of the power source batteries.

I claim:

1. An electric lighting lamp with double light source housed in a case, and containing:

a first bulb fitted in a first connecting base, a second bulb fitted in a second connecting base, and extending parallel to the first bulb, an electrical circuit equipped with a control device of two switches, which are connected respectively in series with said first and second bulbs, and a reflector and transparent screen element for transmission of the light beam emitted by each of said bulbs, a plate supporting the two connecting bases and the electrical circuit, said plate being made of insulating material and subdividing the inside of the case into a first front compartment receiving the bulbs, and a second rear compartment housing the electrical circuit, a switching bar of said control device having two actuating means staggered along a transverse axis in the second compartment, and cooperating alternatively with contact strips constituting the first and second switches to control total extinction or lighting of one of the light bulbs depending on whether the control device is in a break position or an active position, said switching bar being mounted with rotation in a bearing on one of the side faces of the case on the same side as the second fixed-focus bulb, and an adjustment knob separated from the control device and designed to move the first connecting base to focus the light beam emitted by the first bulb.

2. The lighting lamp according to claim 1, wherein a mechanical locking means is associated to the control device to lock the latter in the break position.

3. The lighting lamp according to claim 1, wherein the switching bar is appreciably aligned with a pinion of the adjustment knob in the direction of the transverse axis, and the pinion cooperates with a drive part with crown-wheel securedly united to the first base, which is moved in limited translation when the adjustment knob is rotated.

4. The lighting lamp according to claim 1, wherein the control device comprises a lever or handle coupled to the switching bar and capable of occupying selectively three distinct angular positions, said break position being situated half-way between the two active end-of-travel positions.

5. The lighting lamp according to claim 4, wherein the mechanical locking means is formed by a latch associated to the gripping handle, and in the break position the latch can be depressed to a locked position to perform locking in rotation of the switching bar due to the locking effect of the handle.

6. The lighting lamp according to claim 1, wherein the electrical circuit comprises a plurality of contact elements in the form of interconnected blades, having at least one deformable connection zone arranged between the first movable connecting base and the two movable contact strips of the switches to ensure electrical continuity when the adjustment knob is rotated.

7. The lighting lamp according to claim 6, wherein the electrical circuit comprises:

a first contact element comprising an end having a first self-baring contact, connected to a first intermediate contact strip in engagement with one of the pins of the second bulb and to a second contact strip forming part of the first switch, a second contact element equipped with an earth ring in contact with the bottom of the first bulb, and a third contact strip cooperating with the second contact strip to form said first switch, and a third contact element provided with a fourth contact strip in permanent contact with the isolated terminal of the first bulb, with a bracket having a second self-baring contact, and with a fifth contact strip forming part of the second switch at the level of the fixed second base.

8. The lighting lamp according to claim 7, wherein the conductors of the power supply cable are connected to the electrical circuit by inserting the first and third contact strips respectively in the first and second self-baring contacts.

9. The lighting lamp according to claim 7, wherein the first switch is connected in the earth ring circuit of the first bulb, and the second switch is connected in a branch of the circuit of opposite polarity for supply of the second bulb.

10. The lighting lamp according to claim 1, wherein the plate is positioned on a plurality of guiding studs cast with the case, each stud being formed by a leg fixed to the base plate of the case, and extending in a direction appreciably perpendicular to the screen.

* * * * *